US010749305B2

(12) United States Patent
Zhao et al.

(10) Patent No.: US 10,749,305 B2
(45) Date of Patent: Aug. 18, 2020

(54) ELECTRICAL CONNECTOR WITH SEALING MEMBER FORMED AFTER MOUNTING UPON PRINTED CIRCUIT BOARD

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Jun Zhao, Huaian (CN); Ting-Jie Zhu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/412,392

(22) Filed: May 14, 2019

(65) Prior Publication Data

US 2019/0348808 A1 Nov. 14, 2019

(30) Foreign Application Priority Data

May 14, 2018 (CN) ..... 2018 1 0454381
May 14, 2018 (CN) ..... 2018 1 0454382

(51) Int. Cl.
*H01R 43/00* (2006.01)
*H01R 13/52* (2006.01)
(Continued)

(52) U.S. Cl.
CPC ..... *H01R 43/005* (2013.01); *H01R 12/707* (2013.01); *H01R 13/521* (2013.01);
(Continued)

(58) Field of Classification Search
CPC ..... H01R 13/658; H01R 13/65802; H01R 13/6581–6597; H01R 13/5202;
(Continued)

(56) References Cited

U.S. PATENT DOCUMENTS 6,926,540 B1 * 8/2005 Juntwait ..... H01R 12/585 439/276
7,762,845 B1 * 7/2010 Huang ..... H01R 13/6595 439/607.22

(Continued)

FOREIGN PATENT DOCUMENTS

CN 203967331 U 11/2014
CN 204118373 U 1/2015
CN 206471572 U 9/2017

*Primary Examiner* — Gary F Paumen
(74) *Attorney, Agent, or Firm* — Wei Te Chung; Ming Chieh Chang

(57) ABSTRACT

A electrical connector includes a terminal module and a metallic shell receiving the terminal module. The terminal module includes an insulative housing and a plurality of terminals retained in the housing. The housing includes a base intimately enclosed within the shell, and a tongue extending forwardly from the base. The contact includes a front contacting section, a rear soldering section and a middle retaining section therebetween. The base forms in a peripheral surface a circumferential or race course like groove which is isolated from an exterior along a front-to-back direction, and the shell forms an upward opening in a top wall and downwardly communicates with the groove so as to inject the glue into the groove through the opening to form the glue structure only after the connector is soldered upon the printed circuit board.

20 Claims, 26 Drawing Sheets

(51) Int. Cl.

| | |
|---|---|
| ***H01R 12/70*** | (2011.01) |
| ***H01R 13/6585*** | (2011.01) |
| ***H01R 43/20*** | (2006.01) |
| ***H01R 107/00*** | (2006.01) |
| ***H01R 24/60*** | (2011.01) |

(52) U.S. Cl.
CPC ..... *H01R 13/5202* (2013.01); *H01R 13/6585* (2013.01); *H01R 43/205* (2013.01); *H01R 24/60* (2013.01); *H01R 2107/00* (2013.01)

(58) Field of Classification Search
CPC .. H01R 13/521; H01R 43/005; H01R 43/205; H01R 24/60; H01R 2107/00; H01R 12/707
USPC ..... 439/607.01–607.58
See application file for complete search history.

(56) References Cited

U.S. PATENT DOCUMENTS

| | | | | |
|---|---|---|---|---|
| 8,801,463 | B2 * | 8/2014 | Tan | H01R 13/5202 439/607.04 |
| 9,553,410 | B2 * | 1/2017 | Zhao | H01R 13/6581 |
| 9,774,130 | B2 * | 9/2017 | Zhao | H01R 4/02 |
| 9,997,862 | B2 * | 6/2018 | Zhou | H01R 13/6275 |
| 2015/0056858 | A1 * | 2/2015 | Guo | H01R 12/722 439/607.35 |
| 2016/0093985 | A1 * | 3/2016 | Zhang | H01R 13/6586 439/607.07 |

* cited by examiner

ELECTRICAL CONNECTOR WITH SEALING MEMBER FORMED AFTER MOUNTING UPON PRINTED CIRCUIT BOARD

BACKGROUND OF THE INVENTION

1. Field of the Invention

The present invention relates generally to an electrical contact, and more particularly to the electrical connector having a sealing member formed and attached to the connector after the connector is mounted to a print circuit board.

2. Description of Related Arts

China Patent No. CN206471572 having the same applicant and the same inventor with the instant application, discloses a USB (Universal Serial Bus) Type C connector equipped with a sealing ring, which is received within a circumferential groove in the housing, for waterproofing. U.S. Pat. Nos. 9,553,410, 9,774,130 and 9,997,862 having the same applicant and the same inventor with the instant application, disclose the USB Type C connector equipped with a rearwardly exposed waterproofing plate. Anyhow, all existing Type C connectors essentially requisitely have the corresponding waterproofing structures assembled or formed upon the housing thereof before the connector is soldered upon the printed circuit board, thus likely inevitably resulting in potential cracking due to possible bubbles embedded within the preformed waterproofing structure or different thermal expansion coefficients between the metallic shell and the glue structure disadvantageously after the connector is soldered, by heat, upon the printed circuit board.

Hence, an electrical connector mounted upon the printed circuit board and equipped with the waterproofing structure without the potential cracking defect, is desired.

SUMMARY OF THE INVENTION

To achieve the above object, an electrical connector includes a terminal module and a metallic shell receiving the terminal module. The terminal module includes an insulative housing and a plurality of terminals retained in the housing. The housing includes a base intimately enclosed within the shell, and a tongue extending forwardly from the base. The contact includes a front contacting section, a rear soldering section and a middle retaining section therebetween. The base forms in a peripheral surface a circumferential or race course like groove which is isolated from an exterior or outside along a front-to-back direction, and the shell forms an upward opening in a top wall and downwardly communicates with the groove so as to inject the glue into the groove through the opening to form the glue structure only after the connector is soldered upon the printed circuit board for preventing cracking due to bubblers in the glue structure, wherein the glue structure is intimately located between the shell and the housing for superior waterproofing therebetween along the front-to-back direction. In an alternate arrangement, a channel is located between and communicates with at least one of the upper side and the lower side of the race course like groove so as to form an additional vertical plate of the glue structure for enhancing waterproofing between the contacts and the housing in the front-to-back direction.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
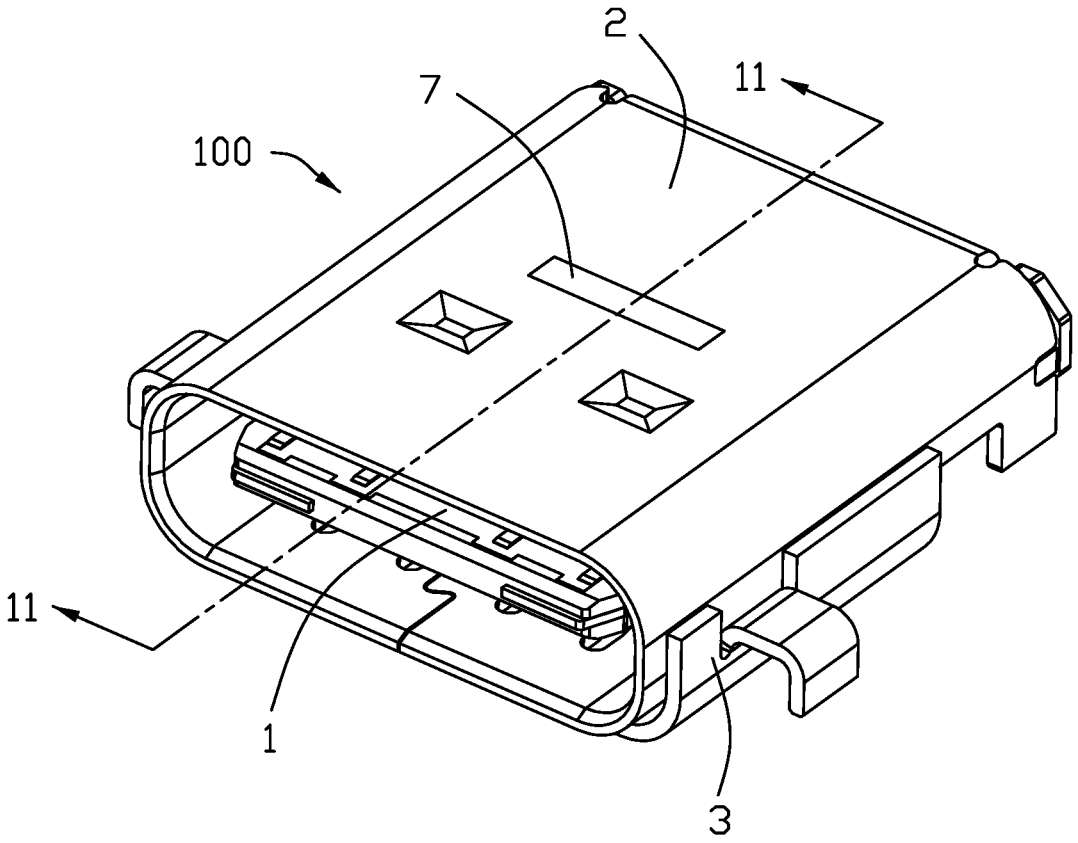
FIG. 1 is a perspective view of the electrical connector of a first preferred embodiment of the present invention.
Figure 2:
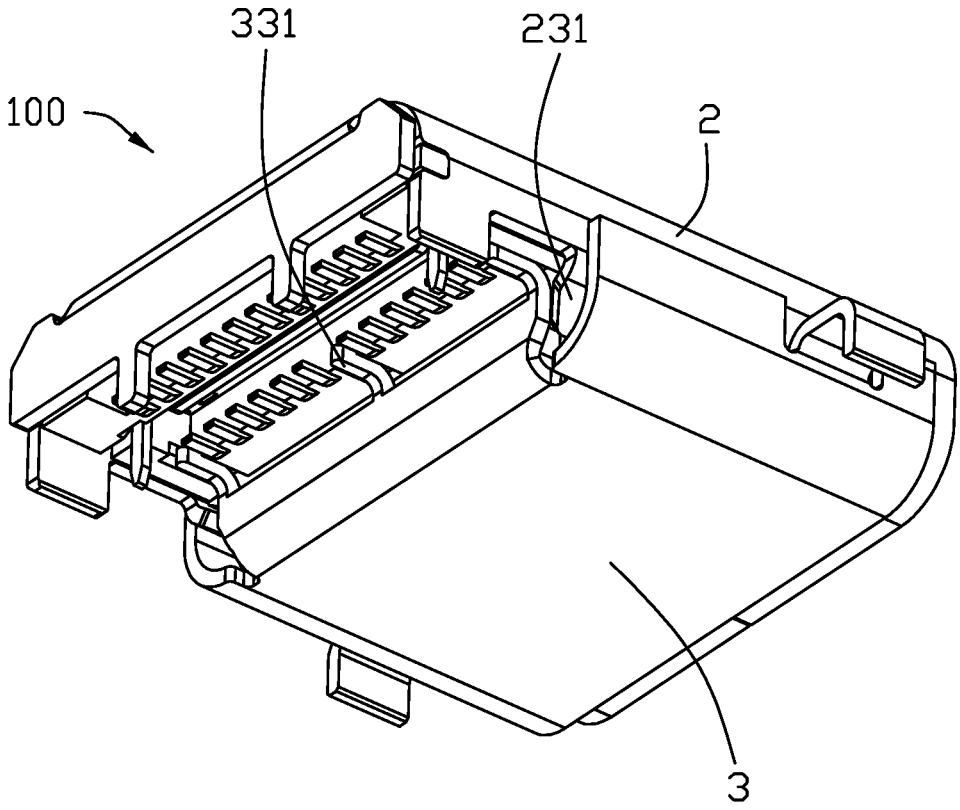
FIG. 2 is another perspective view of the electrical connector of FIG. 1.
Figure 3:
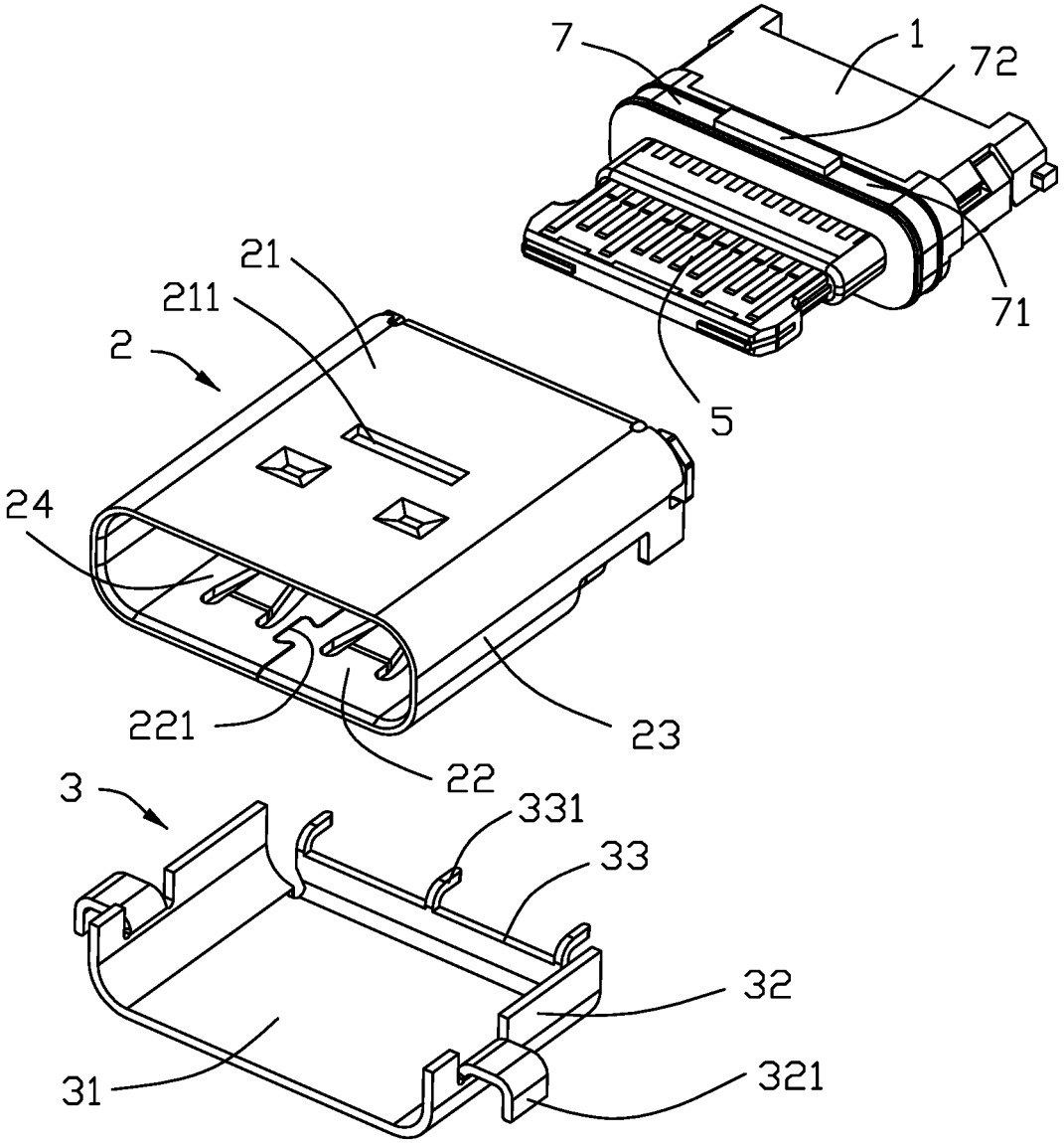
FIG. 3 is an exploded perspective view of the electrical connector of FIG. 1.
Figure 4:
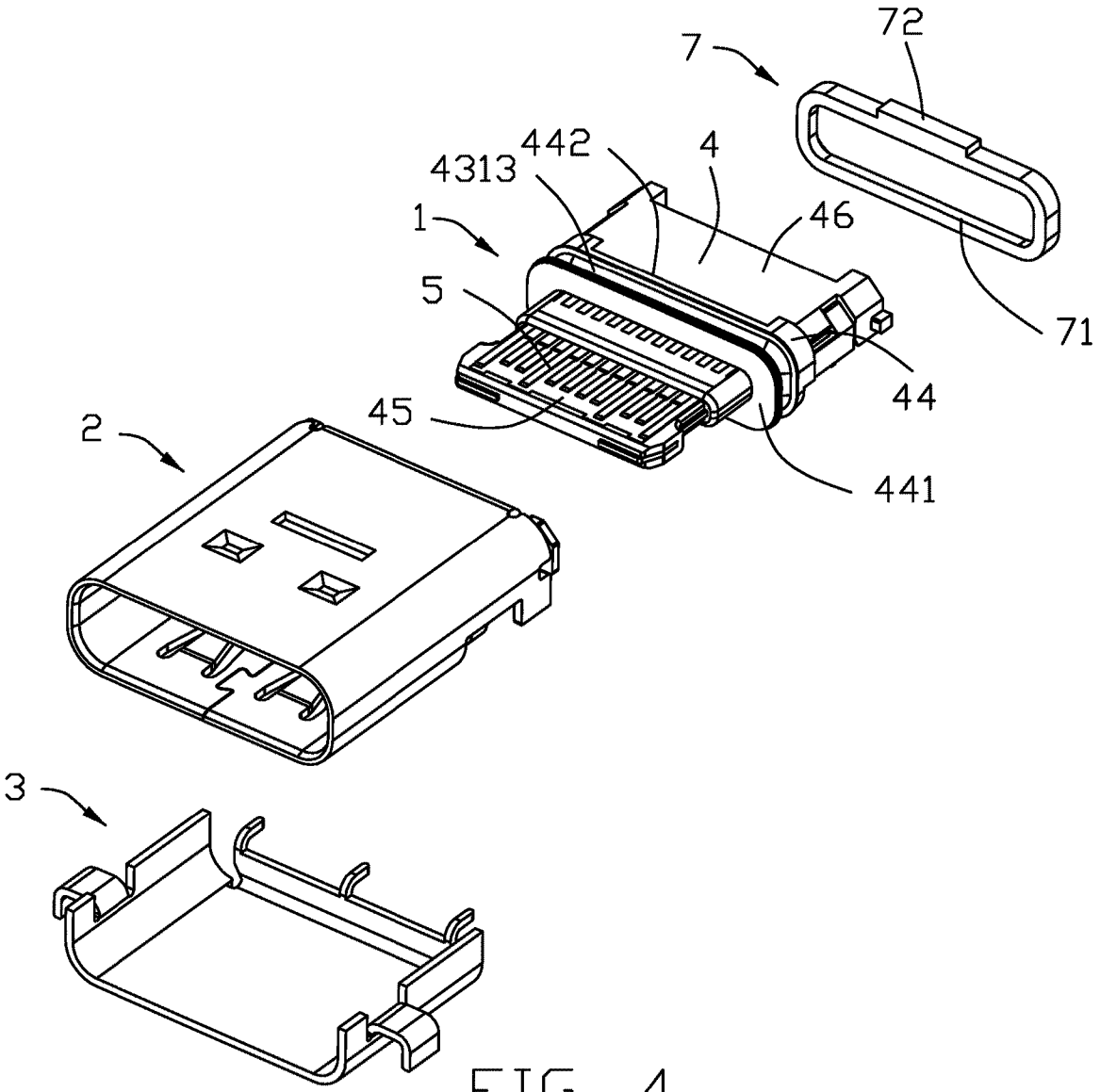
FIG. 4 is a further exploded perspective view of the electrical connector of FIG. 3.
Figure 5:
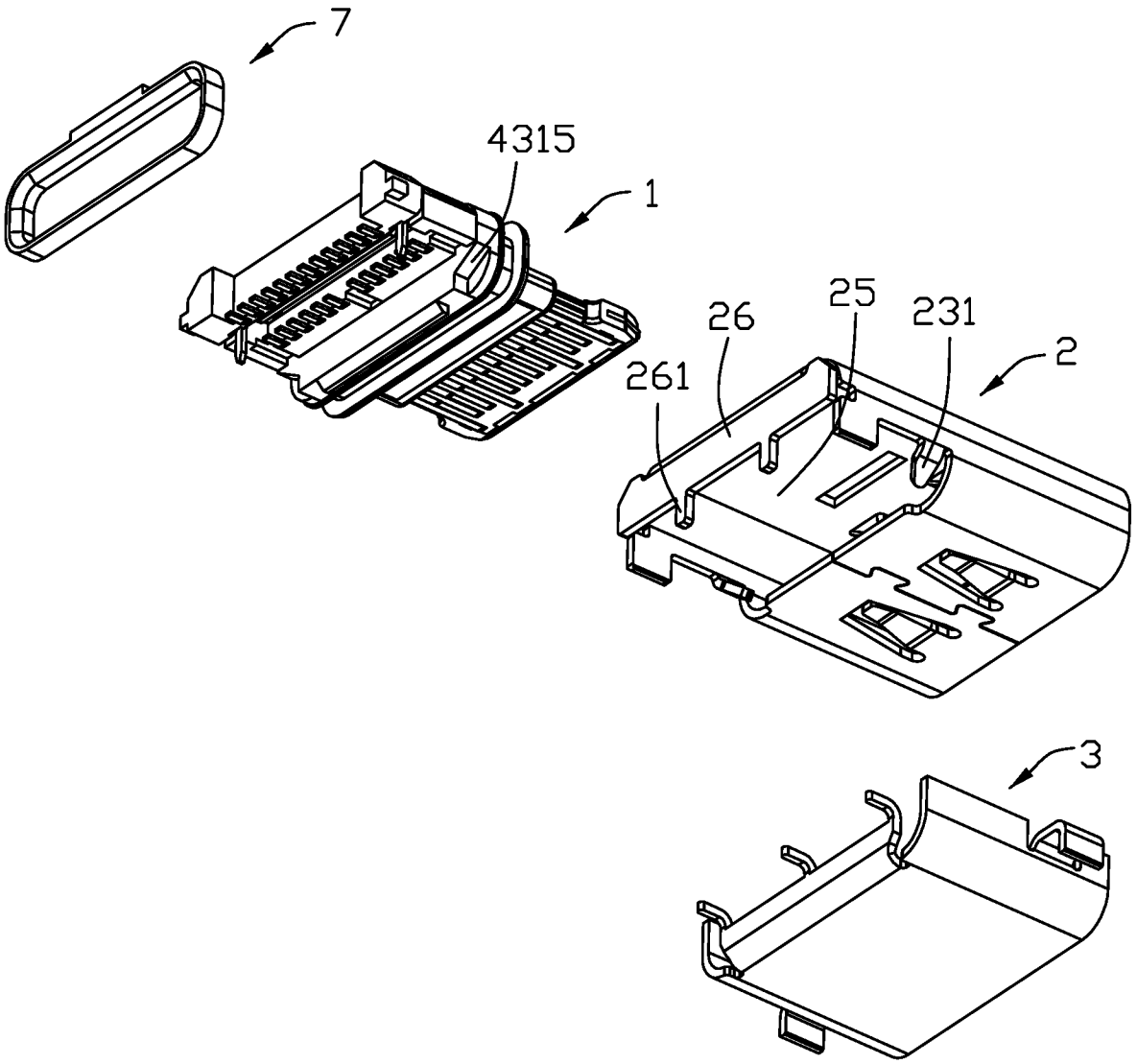
FIG. 5 is another exploded perspective view of the electrical connector of FIG. 4.
Figure 6:
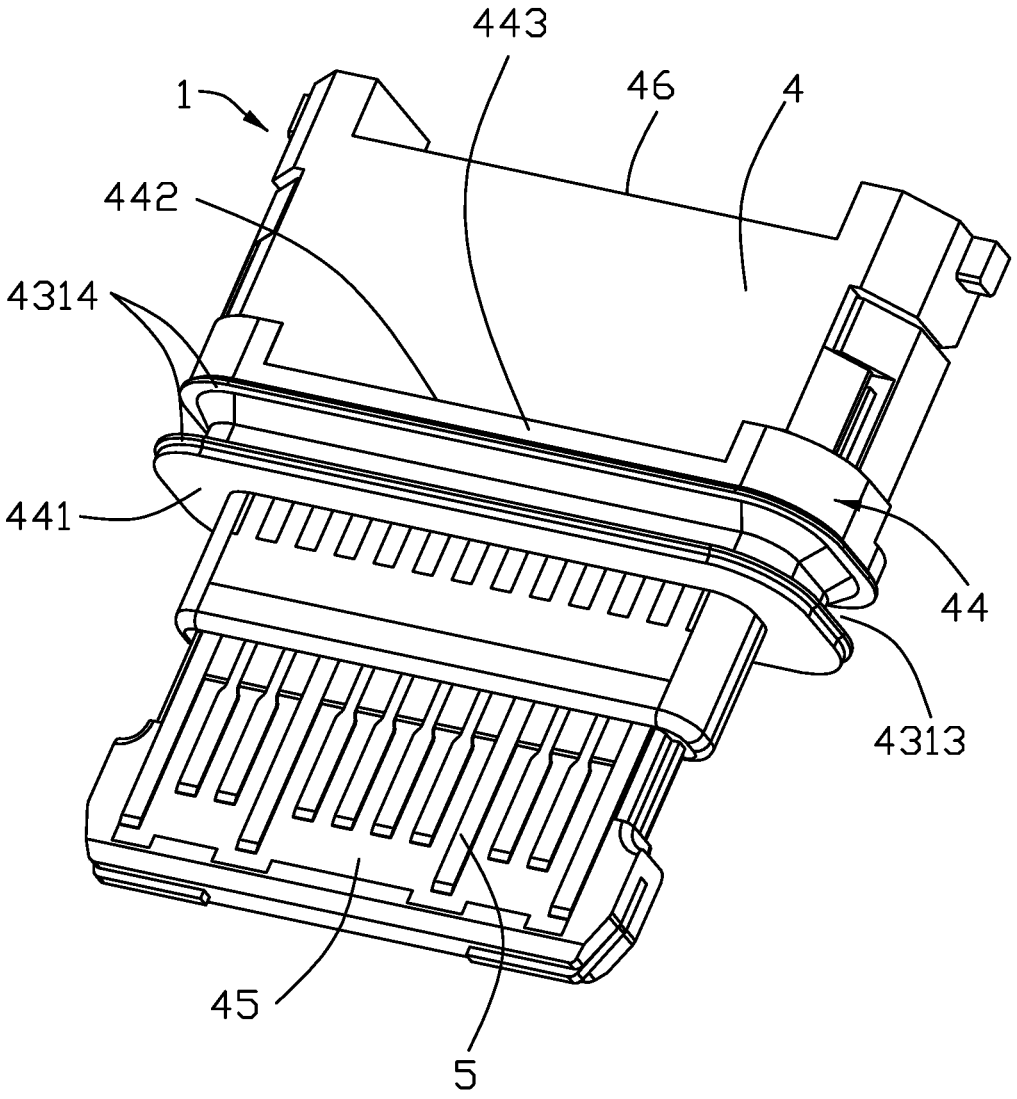
FIG. 6 is a perspective view of the terminal module of the electrical connector of FIG. 1.
Figure 7:
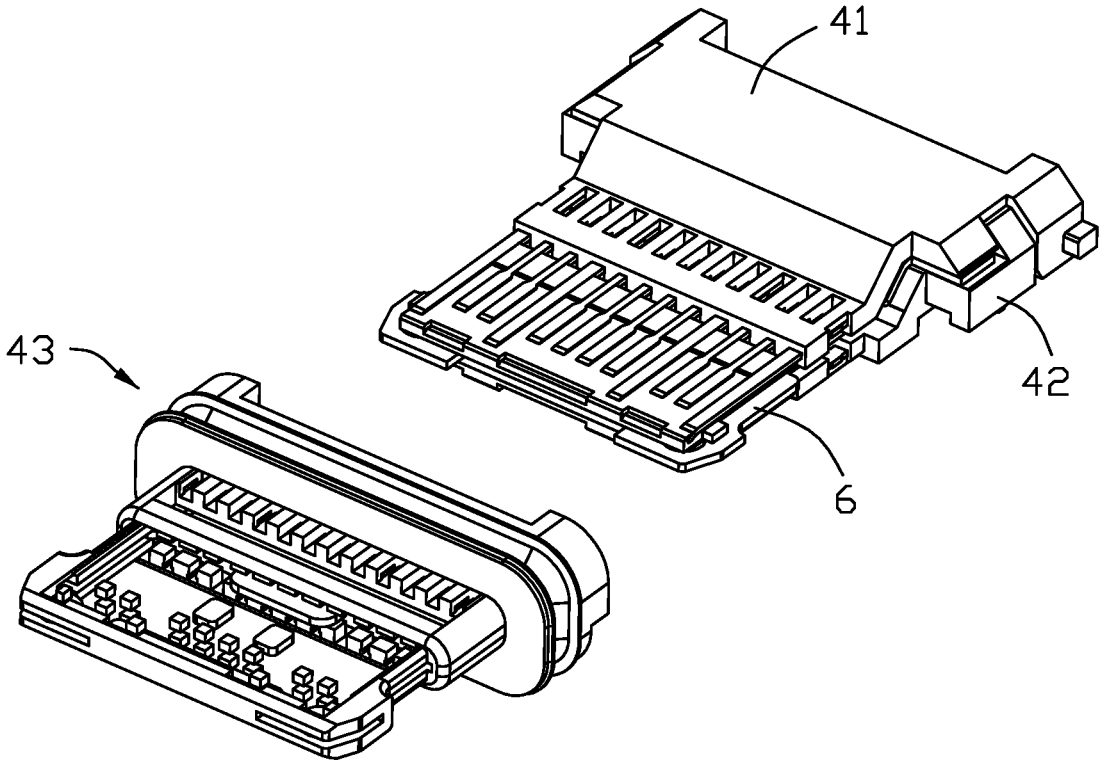
FIG. 7 is an exploded perspective view of the terminal module of the electrical connector of FIG. 6.
Figure 8:
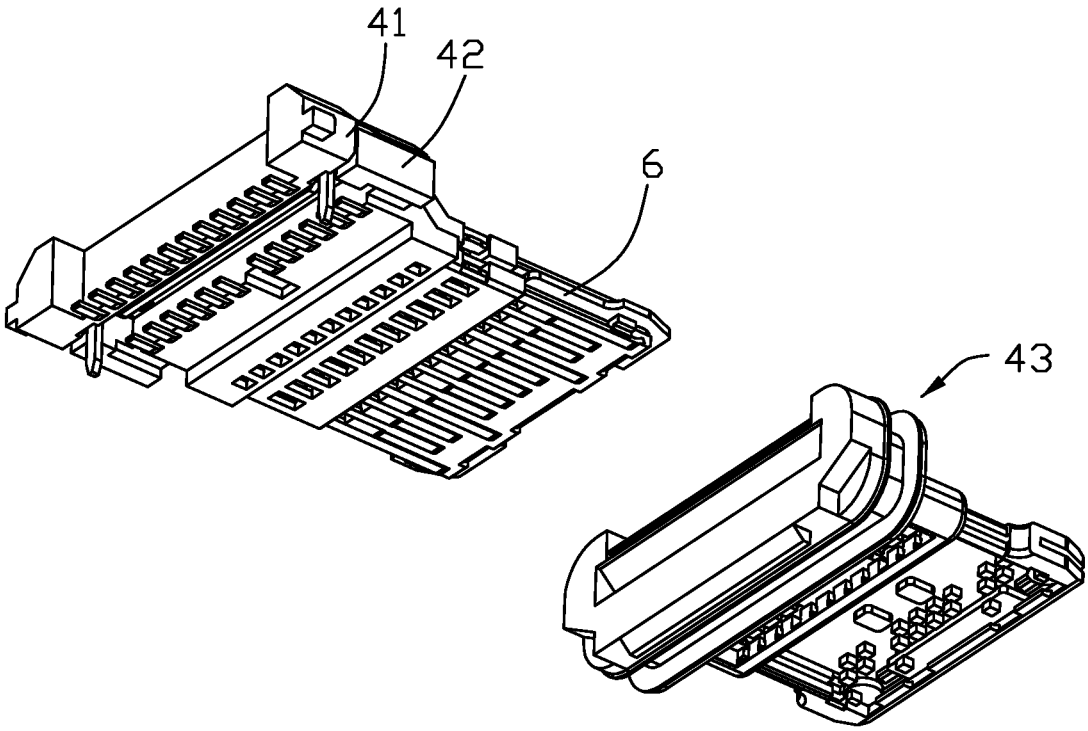
FIG. 8 is another exploded perspective view of the terminal module of the electrical connector of FIG. 7.
Figure 9:
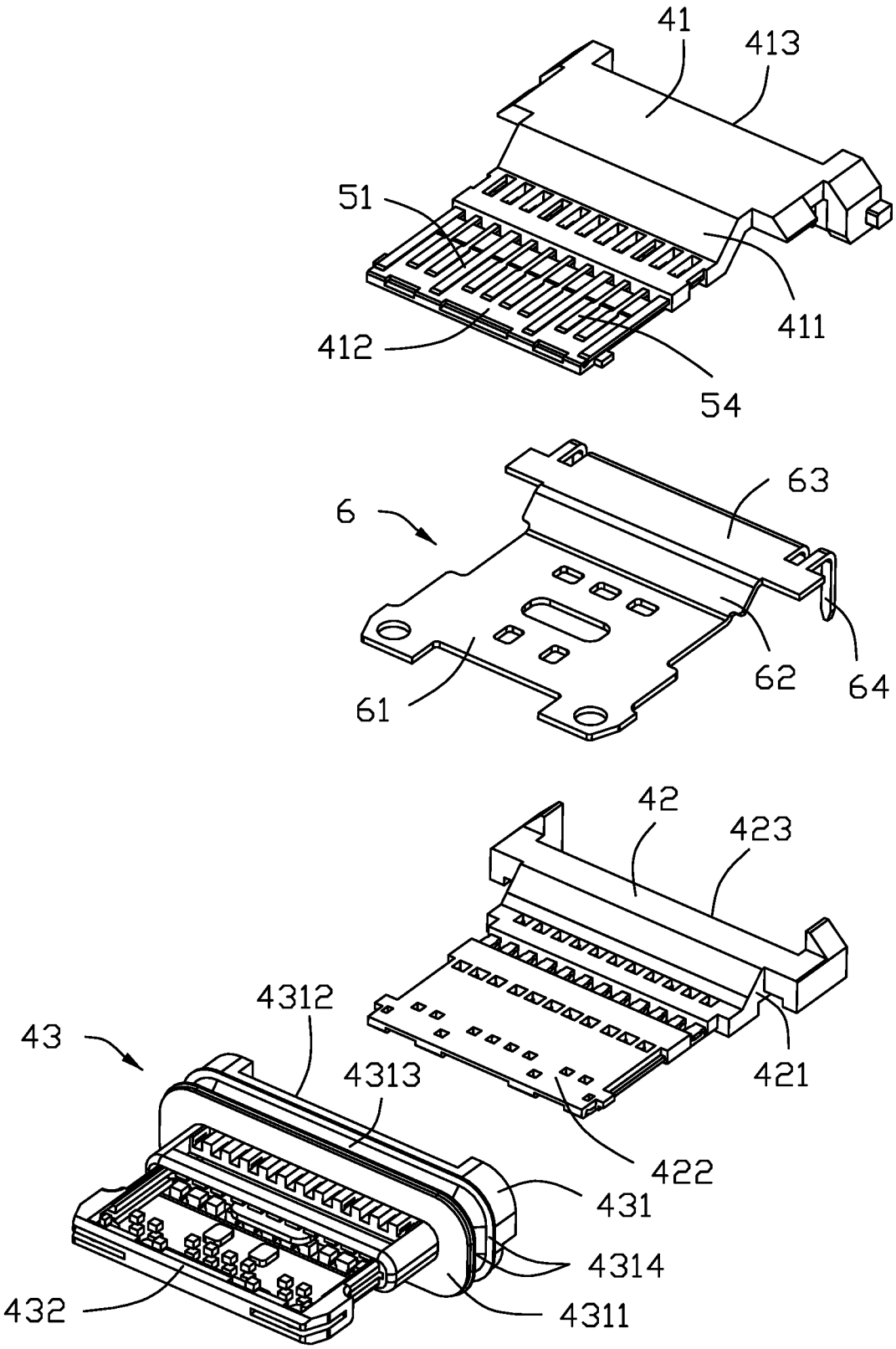
FIG. 9 is a further exploded perspective view of the terminal module of the electrical connector of FIG. 7.
Figure 10:
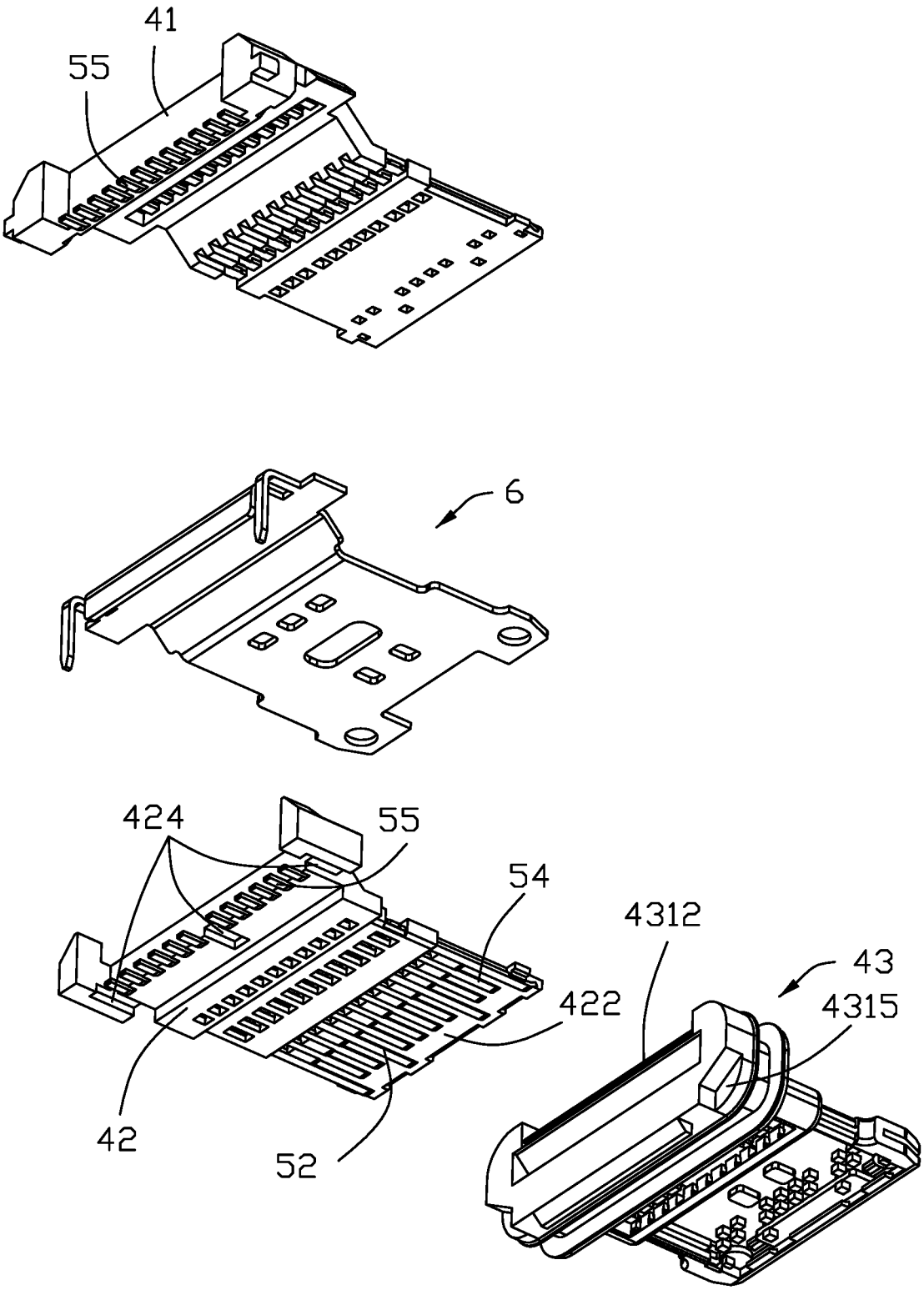
FIG. 10 is another exploded perspective view of the terminal module of the electrical connector of FIG. 9.

Referring to FIGS. 1-11, an electrical connector 100 for mounting to a printed circuit board (not shown) includes a terminal module 1, a metallic shell 2 receiving the terminal module 1, and a metallic sub-shell 3 attached upon the shell 2. The terminal module 1 includes an insulative housing 4, two rows of terminals 5 retained in the housing 4 via an insert-molding process, and a metallic shielding plate 6 between two rows of terminals 5. The housing 4 includes a first insulator 41 and a second insulator 42 assembled with the first insulator 41, and a third insulator 43 over-molded upon the assembled first insulator 41 and second insulator 42. From another viewpoint, the housing 4 includes a base 44, a tongue 45 forwardly extending from the base 44, and a mounting section 46 extending rearwardly from the base 44. The first insulator 41 includes a first base 411, a first tongue 412 extending forwardly from the first base 411, and a first mounting section 413 rearwardly extending from the first base 411. The second insulator 42 includes a second base 421, a second tongue extending forwardly from the second base 421, and a second mounting section 423 rearwardly from the second base 421. The second mounting section 423 forms three receiving slots 424. The third base 43 includes a third base 431, a third tongue 432 extending forwardly from the third base 431. The third base 431 includes a front surface 4311 and a rear surface 4312 opposite to each other in the front-to-back direction, and a circumferential or racecourse like groove 4313 is formed therebetween. In this embodiment, the circumferential groove 4313 refers to the groove 4313 extending with more than 180 degrees relative to 360 degrees circumferentially. A pair of ridges 4314 are formed by two sides of the groove 4313. A pair of retention slots 4315 are formed in the rear surface 4312. Understandably, the first base 411, the second base 421 and the third base 431 commonly form the base 44, the first tongue 412, the second tongue 422 and the third tongue 432 commonly form the tongue 45, and the first mounting section 413 and the second mounting section 423 commonly form the mounting section 46. The front surface 4311 and the rear surface 4312 of the third base 431 form the corresponding front face 441 and the rear face 442 of the base 44 with the ridges 4314 extend beyond the corresponding peripheral surface 443 of the base 44 in the vertical direction.

The terminals 5 includes a plurality of upper (row) contacts 51 and a plurality of lower (row) contacts 52 wherein the pin assignment of those upper contacts 51 and lower contacts 52 are arranged in a reversely symmetrical manner. Each of the upper row contacts 51 and the lower row contacts 52 has a retaining section 53, a contacting section 54 extending forwardly from the retaining section 53 for being exposed upon the tongue 45, and a soldering section 55 extending rearwardly from the retaining section 53 for soldering to the printed circuit board (not shown). The upper row contacts 51 are insert-molded within the first insulator 41, and the lower row contacts 52 are insert-molded within the second insulator 42. The contacting section 54 of the upper contacts 51 and those of the lower contacts 52 are respectively exposed upon the corresponding first tongue 412 and second tongue 422, the retaining section 53 of the upper row contacts 51 and those of the lower row contacts 52 are retained within the first base 411 and the second base 421, respectively, and the soldering sections 55 of the upper row contacts 51 and those of the lower row contacts 52 are exposed outside of the first mounting section 413 and the second mounting section 423, respectively.

The shielding plate 6 includes a front section 61, a middle section 62 and a rear section 63 with mounting legs 64 extending downwardly from the rear section 63. The shielding plate 6 is sandwiched between the first insulator 41 and the second insulator 42 in the vertical direction, wherein the front section 61 is sandwiched between the first tongue 412 and the second tongue 422, the middle section 62 is sandwiched between the first base 411 and the second base 421, and the rear section 63 is sandwiched between the first mounting section 413 and the second mounting section 423. Understandably, the first insulator 41 with the associated upper contacts 51 cooperates the second insulator 42 to commonly sandwich the shielding plate 6 therebetween in the vertical direction, and all together overmolded by the third insulator 43.

The shell 2 is metallic and includes four side walls with a receiving space 24 therein. The side walls includes a top wall 21, a bottom wall 22 and a pair of side walls 23 connected therebetween on two lateral sides. The shell 2 is made by stamping and forming via sheet metal with a riveted seam 221. The top wall 21 forms an upward injection opening 211. A downward opening 25 is located behind the bottom all 22 and in front of a rear wall 26 which extends downwardly from a rear edge of the top wall 21 with a pair of mounting legs 261. The downward opening 25 exposes the soldering sections 55 of the terminals 5. A pair of pressing sections 231 are formed on the corresponding side walls 23 and extend toward the receiving space 24 and are received within the corresponding retention slots 4315 so as to retain the terminal module 1 with regard to the shell 2.

The terminal module 1 is received and retained within the receiving space 24 wherein the upward opening 211 is communicatively aligned with the groove 4313 in the vertical direction. The rear wall 26 is initially extends in a horizontal manner to allow the terminal module 1 to be forwardly assembled into the receiving space 24 at the first stage, and successively is bent in a vertical direction after the terminal module 1 is fully received within the receiving space 24 at the second stage for performing superior shielding in the front-to-back direction.

The sub-shell 3 includes a bottom plate 31, a pair of side plates 32 with corresponding mounting legs 321, and a rear plate 33 with three mounting legs 331. The sub-shell 3 is assembled upon the bottom wall 22 and the mounting legs 331 are received within the receiving slots 424.

Figure 11:
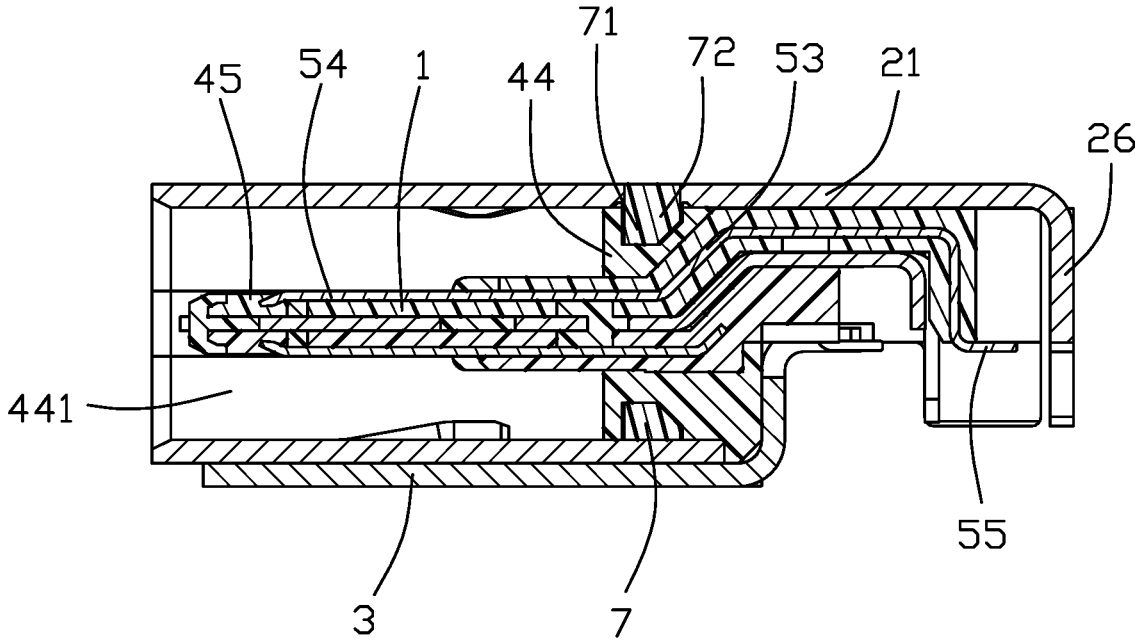
FIG. 11 is a cross-sectional view of the electrical connector of FIG. 11.

The connector 100 further includes a waterproof or glue structure 7 including a ring section 71 received within the groove 4313, and an engagement section 72 received within the opening 211. The waterproof structure 7 is formed by injecting fluidal glue into the groove 4313 via the opening 211 after the connector is soldered upon the printed circuit board. Because ridges 4314 interfere with the interior surface of the shell 2, it is impossible for the fluidal glue to escape from the groove 4313. The waterproof structure 7 is further intimately attached upon the interior surface of the shell 2, thus assuring superior waterproofing between the housing 4 and the shell 2 via such a circumferential ring section 71 of the waterproof structure 7, thus assuring no humidity can penetrate along the front-to-back direction via the gap between the housing 4 and the shell 2. The engagement section 72 not only prevents relative movement of the waterproof structure 7 along the groove 4313 for self-retentoin, but also reinforces the housing 4 in the shell 2 to resist any improper pushing/rearward force from the complementary mating plug connector along the front-to-back direction. In this embodiment, the waterproof structure 7 completely fills the opening 211 while not invading any recess in the bottom wall 22, as shown in FIG. 11.

Figure 12:
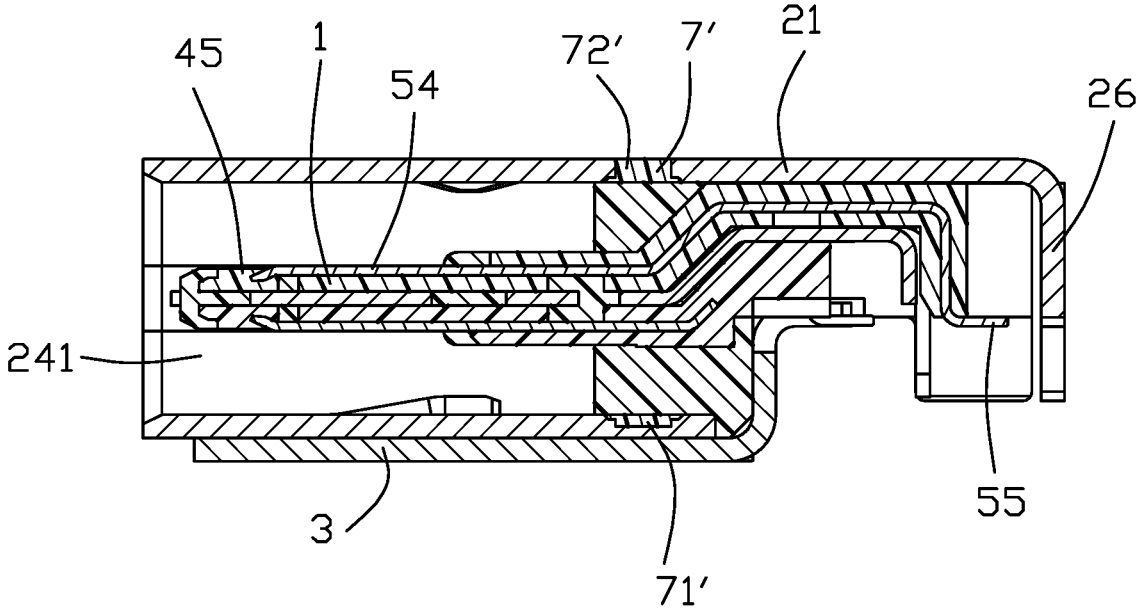
FIG. 12 is a second cross-sectional view of the electrical connector according to a second embodiment of the invention.

Referring to FIG. 12, in the second embodiment the waterproofing structure 7' of the electrical connector 100' includes a ring section 71' and an engagement section 72'.

Instead of forming the circumferential groove in the housing, the shell 2 forms a tiny circumferential groove 4313' aligned with the opening 211' of the shell 2 in the vertical direction. The ridged structures 4314' formed on the base 44' are intimately located beside the groove 4313' for assuring no leakage of the fluidal glue. In other words, the waterproof structure 7' is only applied upon an exterior surface of the housing 2 rather than embedded within any groove in the housing 2.

Figure 13:
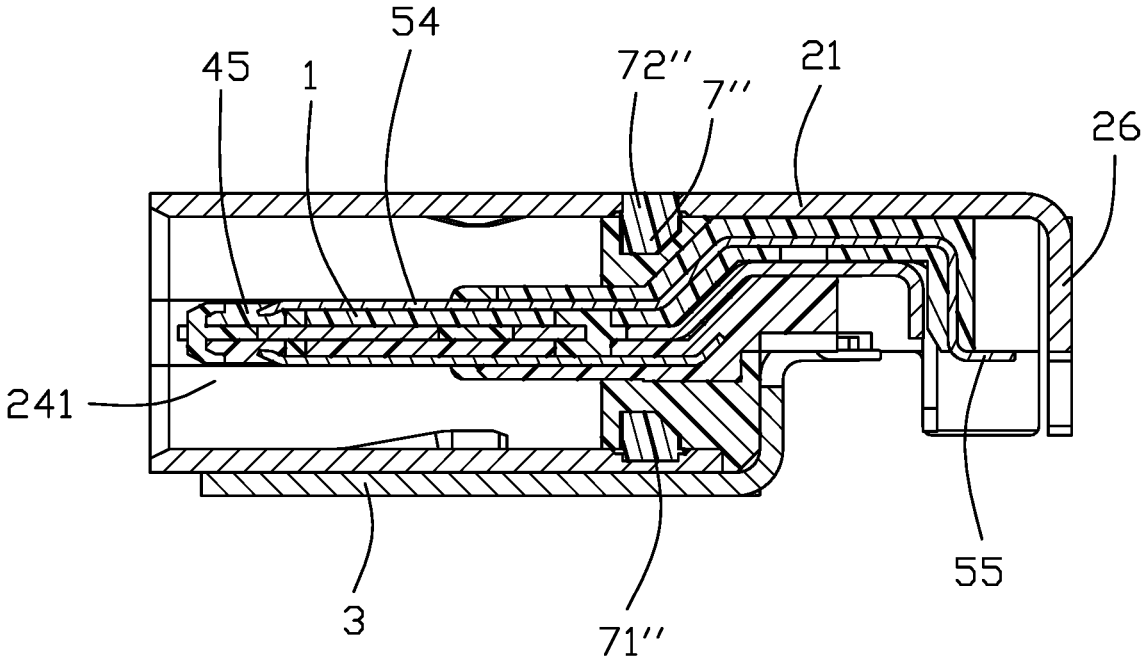
FIG. 13 is a third cross-sectional view of the electrical connector according to a third embodiment of the invention.
Figure 14:
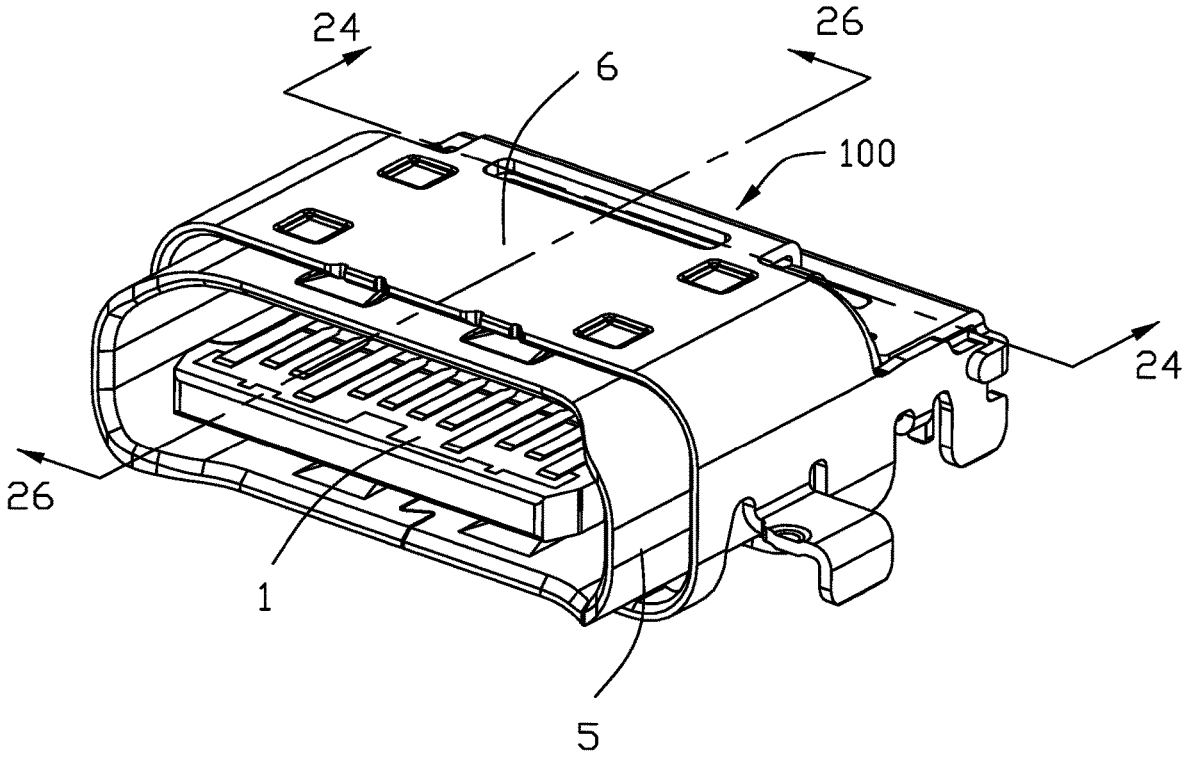
FIG. 14 is perspective view of the electrical contact according to a fourth embodiment of the invention.
Figure 15:
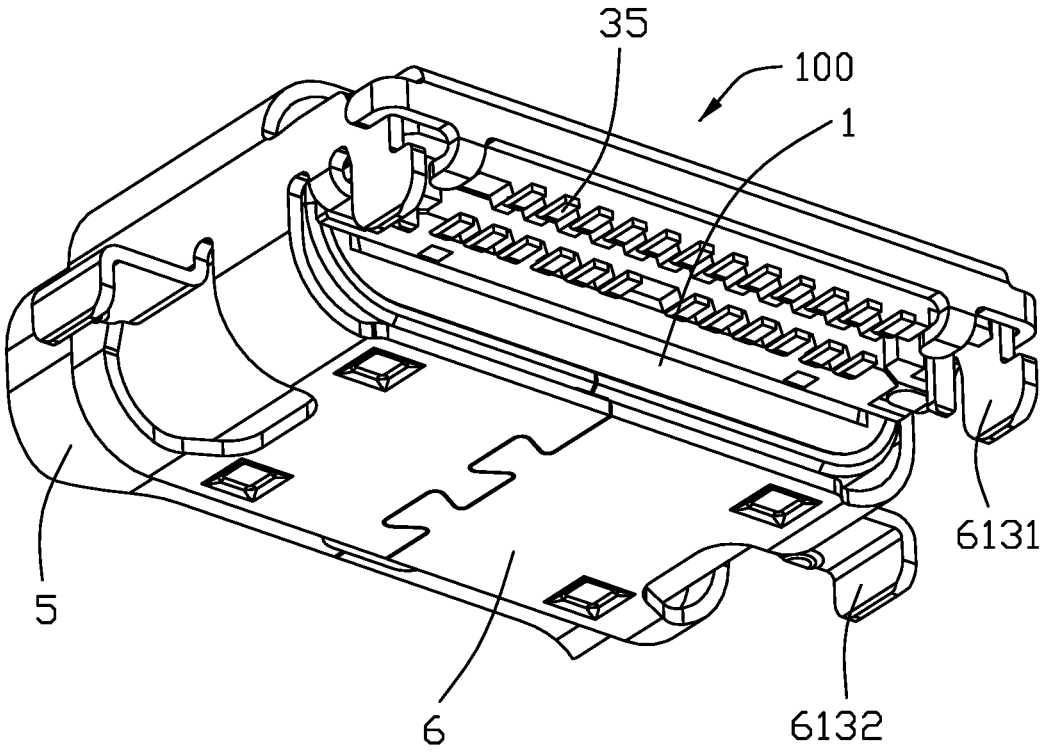
FIG. 15 is another perspective view of the electrical connector of FIG. 14.
Figure 16:
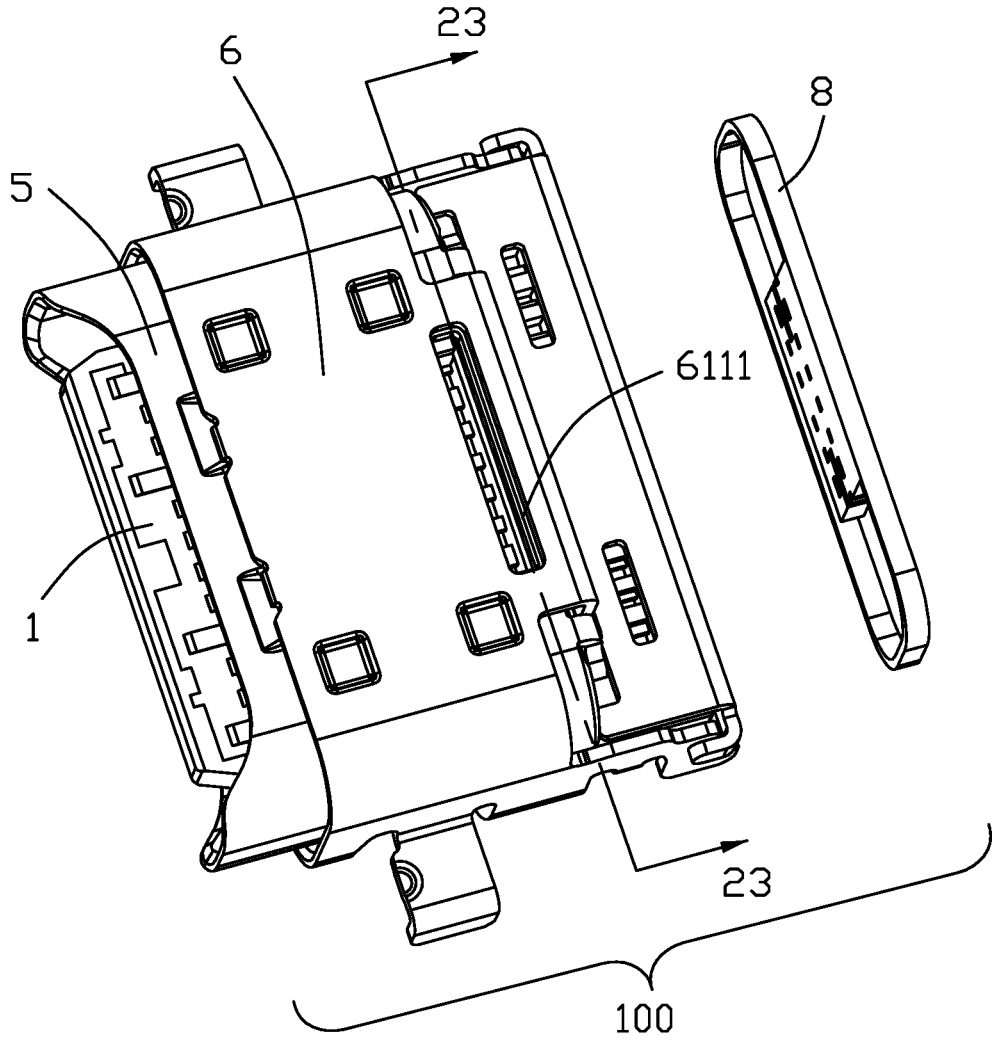
FIG. 16 is an exploded perspective view of the electrical connector of FIG. 14.
Figure 17:
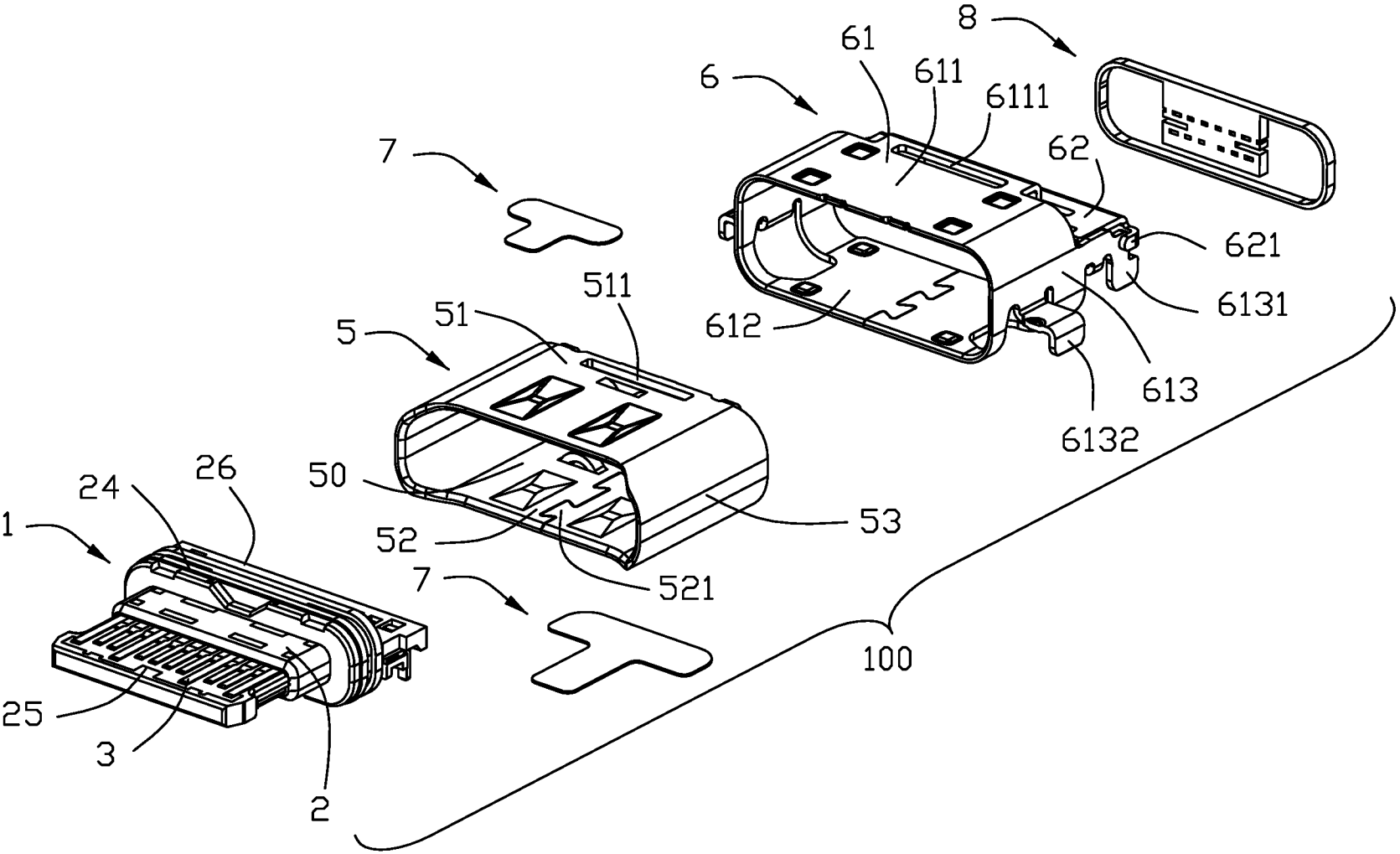
FIG. 17 is a further exploded perspective view of the electrical connector of FIG. 16.
Figure 18:
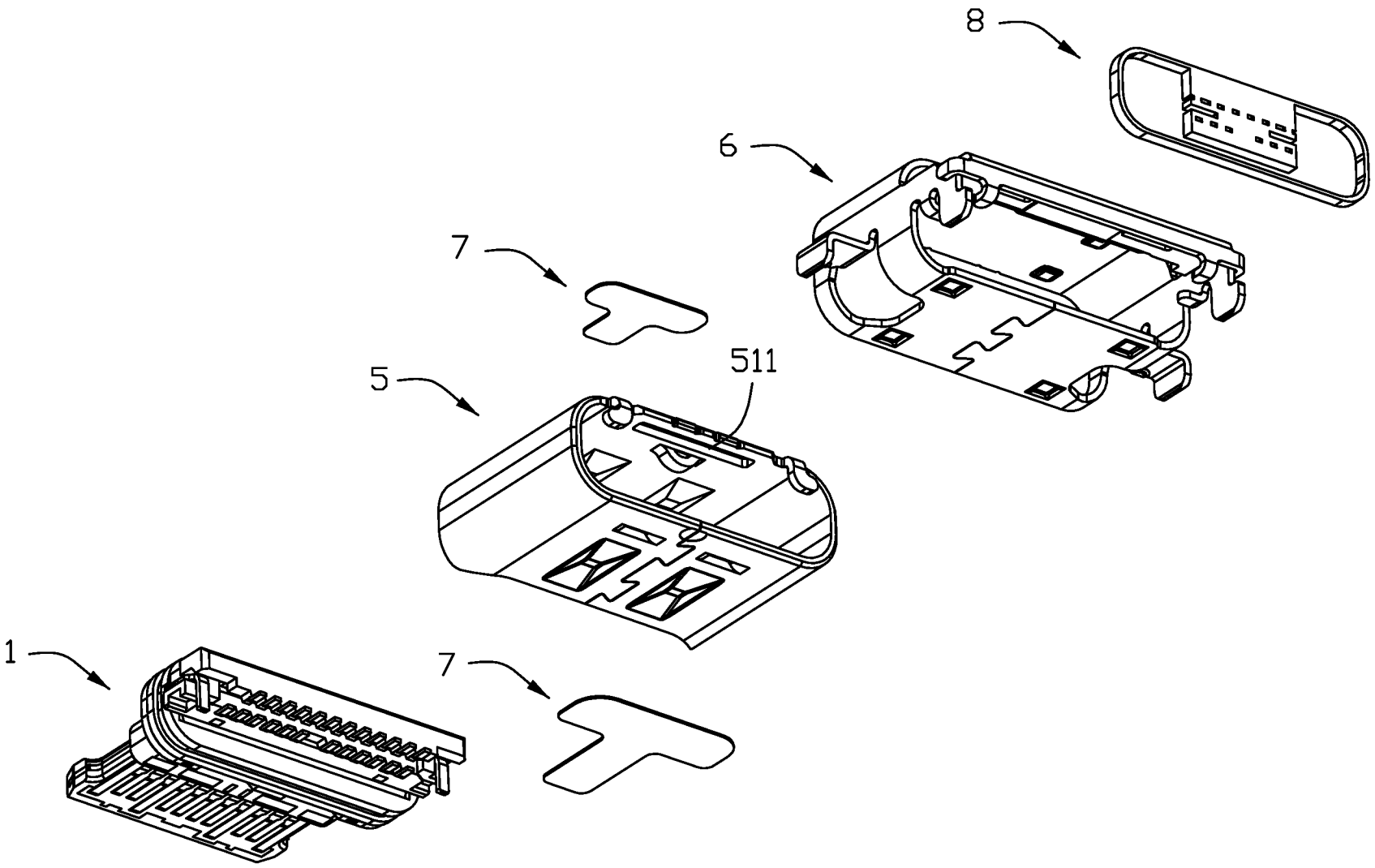
FIG. 18 is another exploded perspective view of the electrical connector of FIG. 17.
Figure 19:
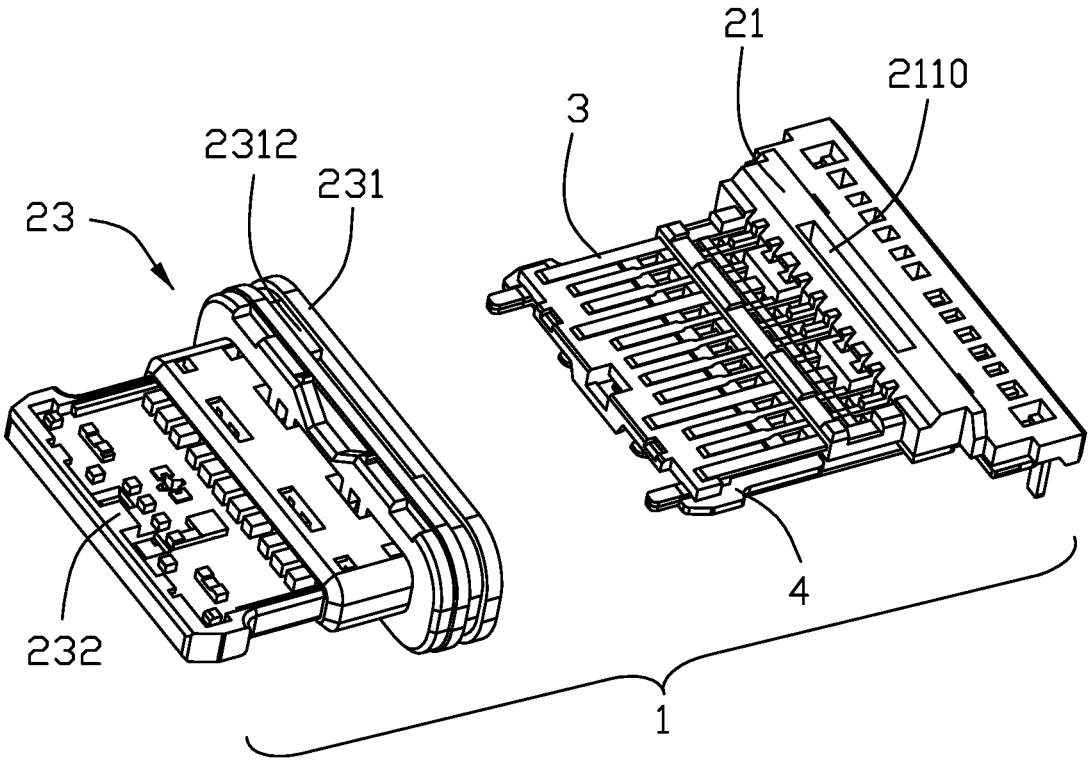
FIG. 19 is an exploded perspective view of the terminal module of the electrical connector of FIG. 14.
Figure 20:
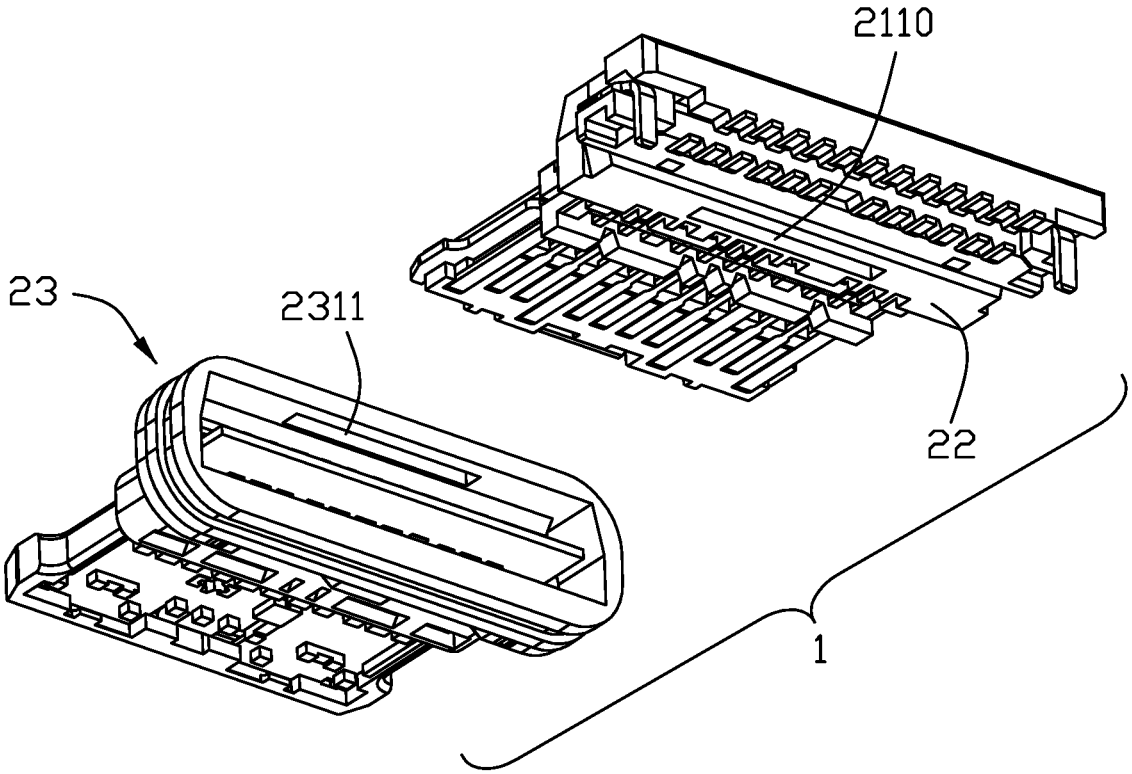
FIG. 20 is another exploded perspective view of the terminal module of the electrical connector of FIG. 19.
Figure 21:
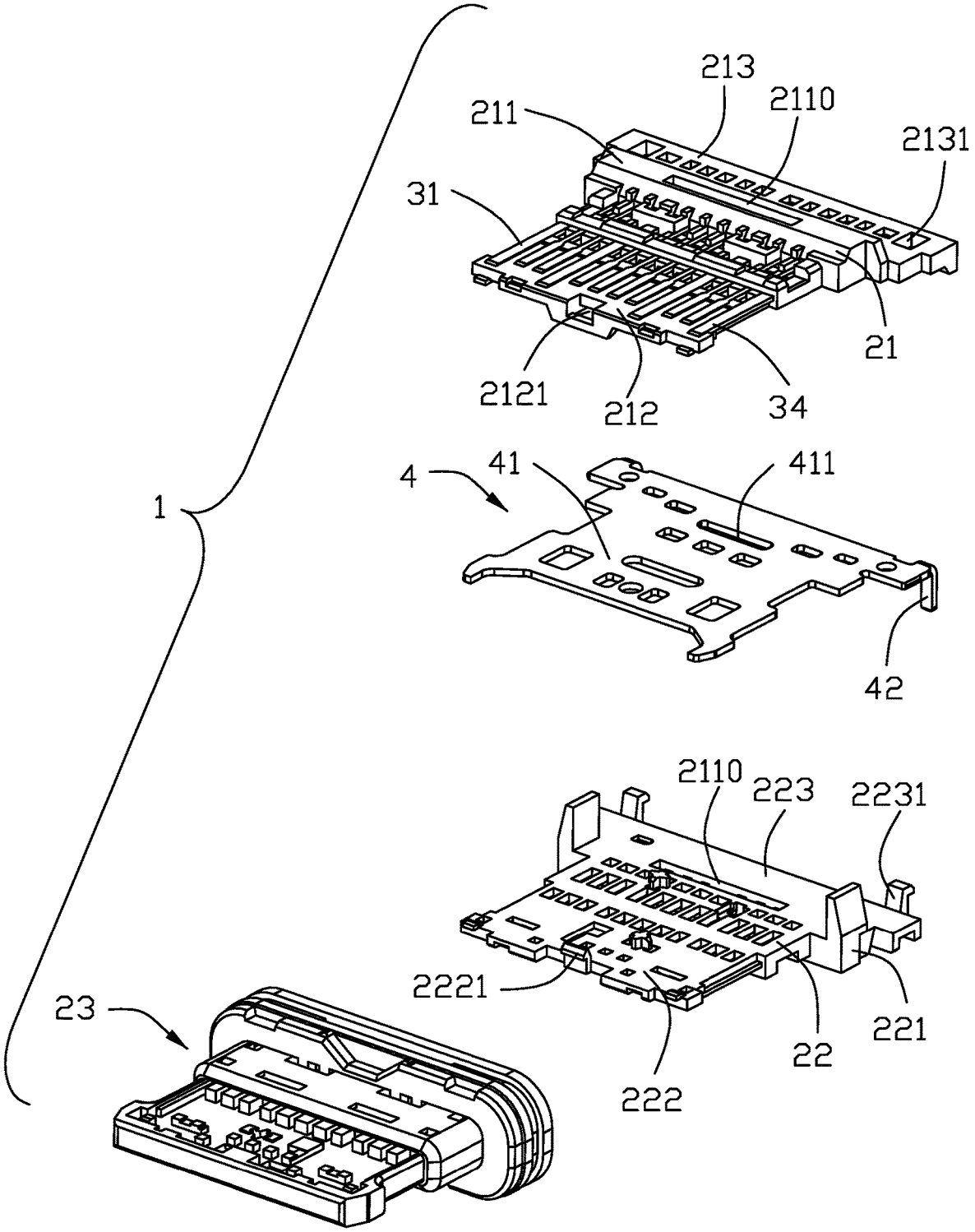
FIG. 21 is a further exploded perspective view of the terminal module of FIG. 19.
Figure 22:
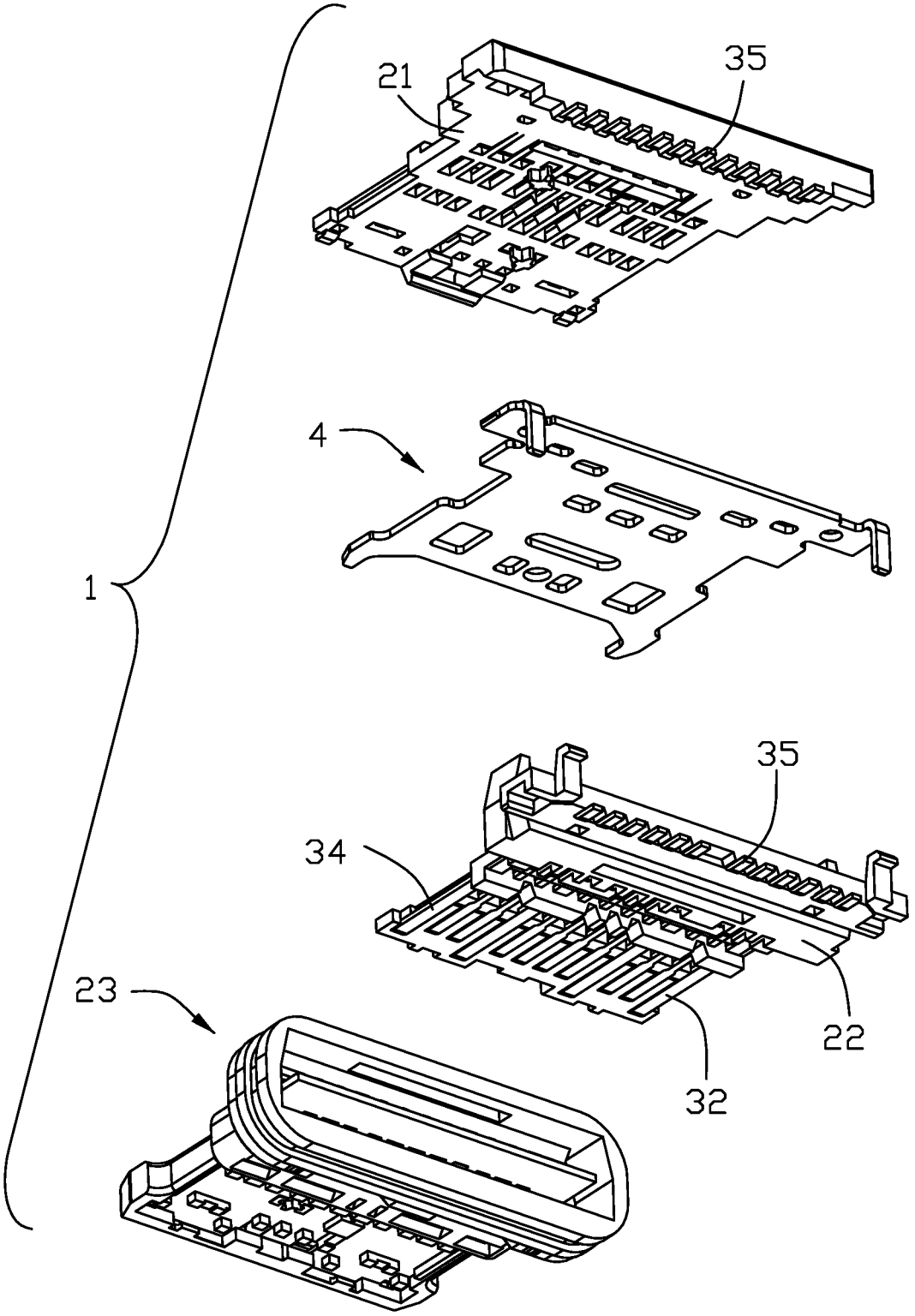
FIG. 22 is another exploded perspective view of ht terminal module of FIG. 21
Figure 23:
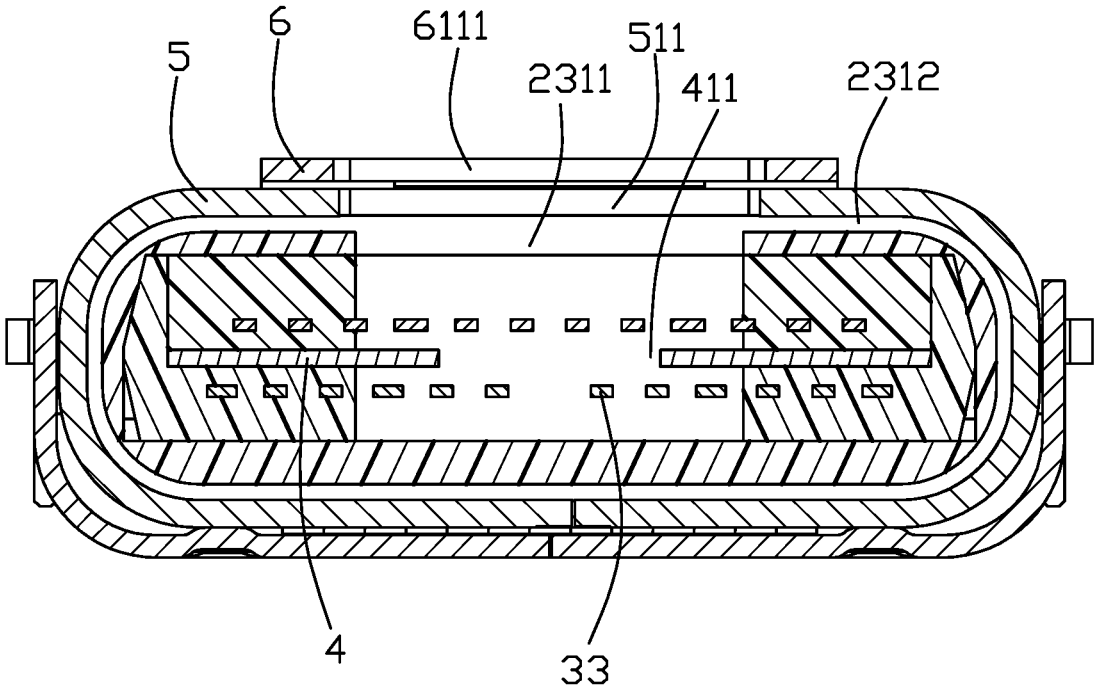
FIG. 23 is a cross-sectional view of the electrical connector of FIG. 14 without the glue structure thereof.
Figure 24:
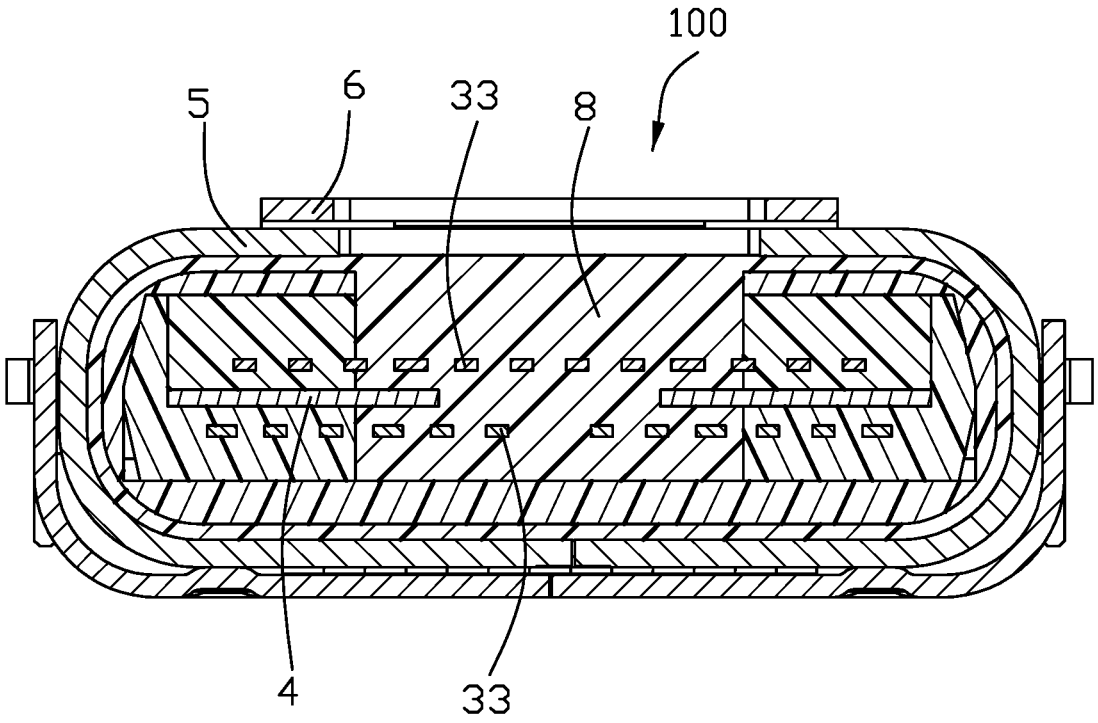
FIG. 24 is a cross-sectional view of the electrical connector of FIG. 14 with the glue structure thereof.

Referring to FIG. 13, the waterproof structure 7" includes a ring like section 71" and an engagement section 72". The base 44 includes an inner circumferential groove 43131" and the shell 2 forms an outer circumferential groove 43132" aligned with the circumferential groove 43131" in the vertical direction to commonly form the circumferential groove 4313" wherein the width of the circumferential groove 43132" is not larger than the circumferential groove 43131" in the front-to-back direction. The circumferential groove 43132" is aligned with the opening 211". The ridges 4314" formed on the base 44, are intimately received within the circumferential groove 43132" so as to assure no leakage during injecting the fluidal glue in the front-to-back direction. Notably, in those embodiment, the engagement section 72 of the waterproof structure 7 is fully received within the opening 211, 211' and 211" without excessive upward protrusion thereof even though being upwardly exposed.

Referring to FIGS. 14-24, the electrical connector 100 includes a terminal module 1 enclosed within a metallic shell unit (not labeled) with waterproof tape 7 and waterproof structure 8. The shell unit includes a metallic inner shell 5 and a metallic outer shell 6.

The terminal module 1 includes an insulative housing 2, a plurality of terminals 3 retained in the housing 2, and a metallic shielding plate 4. The insulative housing 2 includes a first insulator 21, a second insulator 22 assembled to the first insulator 21, and a third insulator 23 over-molded upon the assembled first insulator 21 and second insulator 22. From another viewpoint, the housing 2 includes a base 24, a tongue 25 forwardly extending from the base 24, and a mounting section 26 rearwardly extending from the base 24. The first insulator 21 includes a first base 211, a first tongue 212 extending forwardly from the first base 211, and a first mounting section 213 rearwardly extending from the first base 211. The first tongue 212 forms a first retention hole 2121 and the first mounting section 213 forms a pair of second retention holes 2131. The second insulator 22 includes a second base 221, a second tongue 222 forwardly extending from the second base 221, and a second mounting section 223 extending rearwardly from the second base 222. The second tongue 222 forms a first retention section 2221 engaged within the first retention hole 2121, and the second mounting section 223 forms a pair of second retention sections 2231 engaged within the first retention holes 2131. Both the first base 211 and the second base 221 form the first spaces 2110 in the vertical direction. The third insulator 23 forms a third base 231 and a third tongue 232 forwardly extending from the third base 231. The third base 231 forms a second space 2311 in the vertical direction. A circumferential groove 2312 is formed in a peripheral face of the third base 231, and the second space 2311 communicates with the circumferential groove 2312. The first base 211, the second base 221 and the third base 231 commonly form the base 24, and the first tongue 212, the second tongue 222 and the third tongue 232 commonly form the tongue 25. The first mounting section 213 and the second mounting section 223 commonly form the mounting section 26. The circumferential groove 2312 is formed in the periphery of the base 24. The first space 2110 and the second space 2311 are communicatively aligned with each other and further communicates with the upper side of the circumferential groove 2312.

The terminals 3 include a plurality of upper contacts 31 and a plurality of lower contacts 32 arranged reversely symmetrical with each other. Each of the upper contacts 31 and the lower contacts 32 includes a retaining section 33, a contacting section 34 forwardly extending from the retaining section 33, and a soldering section 35 rearwardlye extending from the retaining section 33. The upper contacts 31 are integrally formed within the first insulator 21 via insert-molding as well as the lower contacts 32 are integrally formed within the second insulator 22. The contacting sections 33 are exposed upon the first tongue 212 and the second tongue 222. The retaining sections 33 are retained in the first base 211 and the second base 221 and exposed in the first space 2110, and the soldering sections 35 are exposed outside of the first mounting section 213 and the second mounting section 223.

The shielding plate 4 includes a plate section 41 and a pair of mounting legs 42. The plate section 41 forms an through hole 411. The shielding plate 4 is sandwiched between the first insulator 21 and the second insulator 22 in the vertical direction. The through hole 411 is communicatively aligned with the first space 2110 as explained later.

The third insulator 23 is over-molded upon the assembled first insulator 21 and second insulator 22 with the shielding plate 4 therebetween in the vertical direction.

The inner shell 5 includes a top wall 51, a bottom wall 52 opposite to the top wall 51 in the vertical direction, and a pair of side walls 53 connected therebetween in the vertical direction. The shell 5 is made by stamping and forming with a riveted seam 521. The top wall 51 forms a (first) injection opening 511 communicatively aligned with the circumferential groove 2312 in the vertical direction. The waterproof tapes 7 are attached upon the top wall 51 and the bottom wall 52 for covering the slits (not labeled) due to forming inward protrusions (not labeled) from the top wall 51 and the bottom wall 52 for stopping forward movement of the housing 2 with regard to the shell 5. The outer shell 6 is made of metal and includes a tubular main body 61 and the rear covering section 62. The main body 61 includes a top late 611 and a bottom plate 612 opposite to the top plate 611 in the vertical direction, and a pair of side plates 613 connected therebetween in the vertical direction. Each side plate 613 forms a mounting leg 6131 and a securing leg 6132. The cover section 62 forms a pair of hooks 621. The top plate 611 forms a (second) injection opening 6111 communicatively aligned with the first injection opening 511 in the vertical direction.

Figure 25:
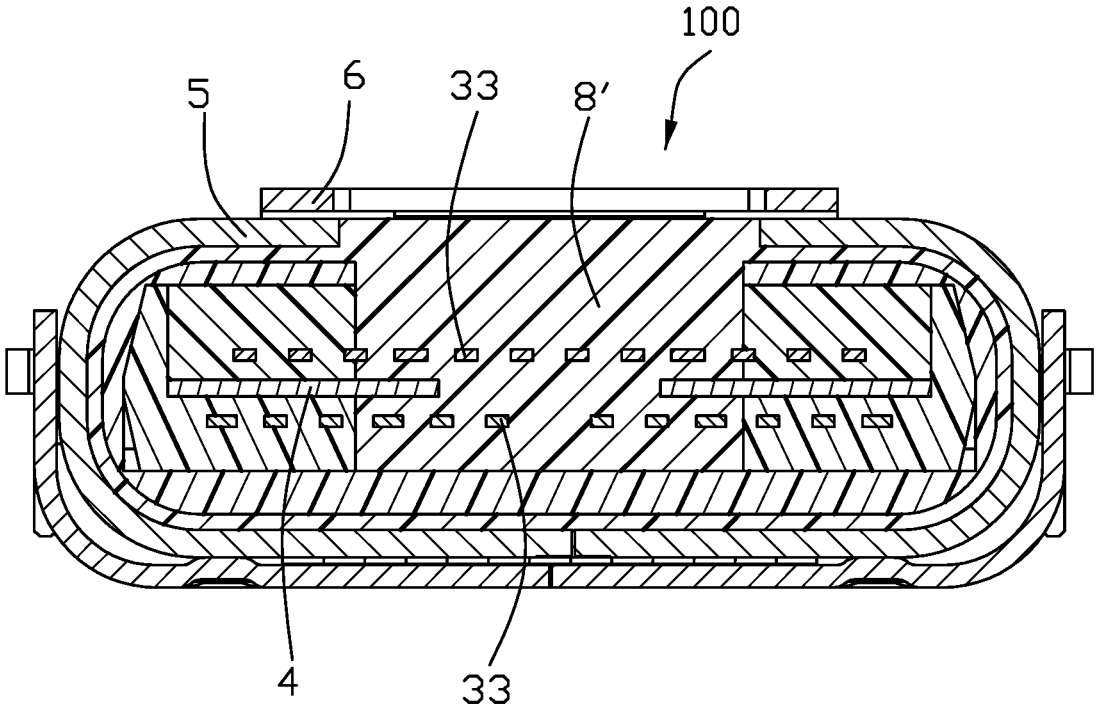
FIG. 25 is another cross-sectional view of the electrical connector according to a fifth embodiment of the invention.
Figure 26:
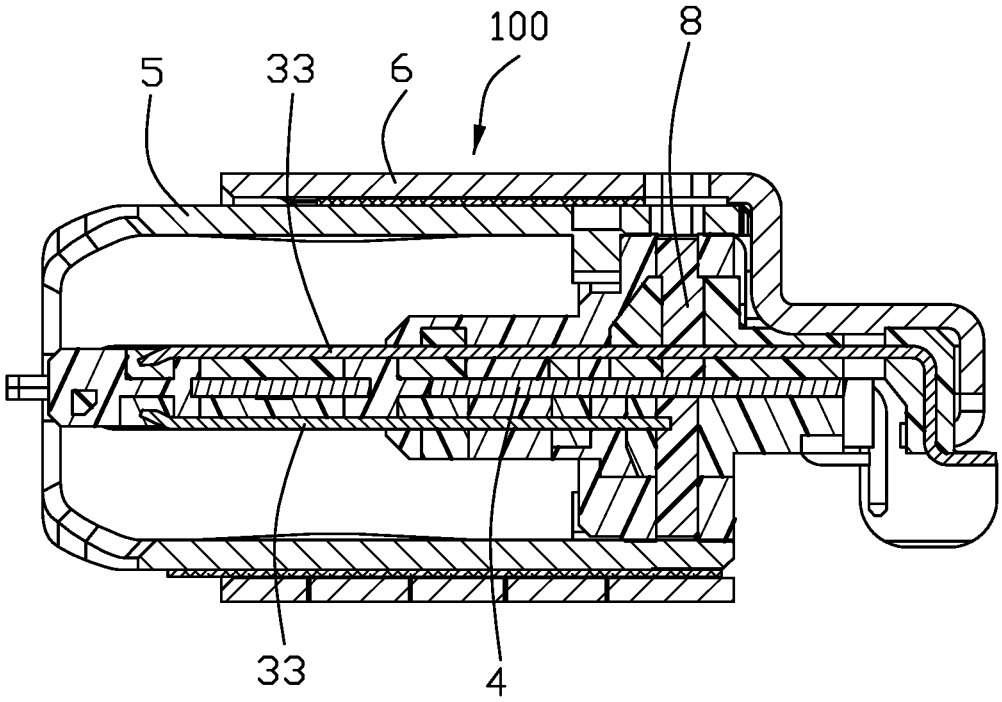
FIG. 26 is another cross-sectional view of the electrical connector of FIG. 14 to show the glue structure is isolated from an exterior in the front-to-back direction.

The connector 100 without the glue structure 8 is firstly soldered upon the printed circuit board. The fluidal glue is successively injected into the first space 2110 via the second injection opening 6111, the first injection opening 511 and the second space 2311. Once the first space 2110 is filled up, and the glue further fills the circumferential groove 2312 and the second space 2311 sequentially. The first injection opening 511 can be also optimally filled with the glue/waterproof structure as shown in FIG. 25. Understandably, the glue structure 8 fills the first space 2110 may enhance waterproofing between the contacts and the housing in the front-to-back direction while that fills the circumferential groove 2312 may enhance waterproofing between the shell and the housing in the front-to-back direction.

In conclusion, the invention essentially provides in the housing a circumferential groove isolated from the exterior in the front-to-back direction while equipped with an upward opening formed in the shell and communicatively aligned with the circumferential groove in the vertical direction so as to have the waterproofing glue filled within the circumferential groove via the injection opening after the connector is soldered upon the printed circuit board without potential cracking defect due to overheat situation derived from the soldering environment.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector for soldering to a printed circuit board, comprising:

a terminal module including an insulative housing and a plurality of contacts retained integrally therein via an insert-molding process, the housing including a base and a tongue forwardly extending from a front portion of the base in a front-to-back direction;

each of said contacts including a front contacting section exposed upon the tongue and a rear soldering section exposed outside of the housing;

a metallic shell enclosing the terminal module and intimately surrounding the base;

an upward injection opening formed in a top wall of the metallic shell; and a circumferential groove formed in a peripheral surface radially contacting an interior surface of the shell, and being isolated from an outside in said front-to-back direction; wherein the injection opening is communicatively aligned with the circumferential groove so that the circumferential groove communicates with the outside only via said injection opening; wherein after the soldering sections of the contacts are soldered to the printed circuit board, a fluidal type waterproofing glue is initially injected into the circumferential groove via the injection opening and successively solidified so as to avoid cracking due to soldering; wherein said injection opening is forwardly distanced from a rear end of the top wall, and is located at a position vertically aligned with said front portion of the base.

2. The electrical connector as claimed in claim 1, wherein the waterproofing glue fills the injection opening to form an engagement section so as to prevent relative movement of the waterproofing glue along the circumferential groove.

3. The electrical connector as claimed in claim 1, wherein the housing forms, along a vertical direction perpendicular to the front-to-back direction, a vertical space communicating with the circumferential groove along said vertical direction, and the contacts are exposed in the space, so that the waterproofing glue fills the space to form a vertical plate through which the contacts extend along the front-to-back direction.

4. The electrical connector as claimed in claim 3, further including a metallic shielding plate between two rows of said contacts in said vertical direction, and said shielding plate forms another space aligned with the vertical space of the housing in the vertical direction and filled by said vertical plate.

5. The electrical connector as claimed in claim 1, wherein the housing forms a pair of ridges by two sides of the circumferential groove so as to enhance isolation of the circumferential groove in the front-to-back direction.

6. The electrical connector as claimed in claim 1, wherein the injection opening is formed in only the top wall of the shell.

7. A method of making an electrical connector comprising steps of:

providing a terminal module with an insulative housing and a plurality of terminals integrally formed with the housing via insert-molding, said housing including a base and a tongue extending forwardly from the base, each of said contacts including, along a front-to-back direction, a front contacting section exposed upon the tongue and a rear soldering section exposed outside of the housing;

forming a circumferential groove in a peripheral surface of the base, said circumferential groove being isolated from an outside in the front-to-back direction;

inserting the terminal module into a metallic tubular shell wherein the peripheral surface of the base intimately contacting radially an interior surface of the shell, and a top wall of the shell forms an upward injection opening communicatively aligned with the circumferential groove in a vertical direction perpendicular to the front-to-back direction;

securing the soldering sections of the contacts to a printed circuit board via soldering; and downwardly injecting fluidal waterproofing glue, along the vertical direction, into the circumferential groove via said injection opening to fill up said circumferential groove after the connector is mounted upon the printed circuit board and when both the connector and the printed circuit board are positioned horizontally.

8. The method as claimed in claim 7, wherein the injection opening is filled with said waterproofing glue to form an engagement section.

9. The method as claimed in claim 7, wherein said housing forms a vertical space communicating with the circumferential groove and filled with the waterproofing glue to form a glue plate through which the contacts extend in the front-to-back direction.

10. The method as claimed in claim 9, wherein the connector further includes a metallic shielding plate located between two rows of said contacts in the vertical direction, and said shielding plate forms a space communicating with said vertical space in the vertical direction and filled with the waterproofing glue.

11. The method as claimed in claim 7, wherein the shell forms another circumferential groove facing said circumferential groove correspondingly with the waterproofing glue filled therein as well.

12. An electrical connector for soldering to a printed circuit board, comprising:

a terminal module including an insulative housing and a plurality of contacts retained integrally therein via an insert-molding process, the housing including a base and a tongue forwardly extending from the base in a front-to-back direction;

each of said contacts including a front contacting section exposed upon the tongue and a rear soldering section exposed outside of the housing;

a metallic shell enclosing the terminal module and intimately surrounding the base;

an upward injection opening formed in a top wall of the metallic shell; and a circumferential groove formed in an interface area of the base and the shell and being isolated from an outside in said front-to-back direction; wherein the injection opening is communicatively aligned with the circumferential groove in a vertical direction perpendicular to the front-to-back direction, so that the circumferential groove communicates with the outside only via said injection opening; wherein after the soldering sections of the contacts are soldered to the printed circuit board, a fluidal type waterproofing glue is initially injected downwardly into the circumferential groove via the injection opening under a situation that both the printed circuit board and the connector are positioned horizontally, and successively solidified so as to avoid cracking due to soldering.

13. The electrical connector as claimed in claim 12, wherein said circumferential groove is formed in at least an peripheral surface of the base.

14. The electrical connector as claimed in claim 12, wherein said circumferential groove is formed in at least an interior surface of the shell.

15. The electrical connector as claimed in claim 12, wherein the housing forms a vertical space communicating with the circumferential groove and filled with the waterproofing glue to form a vertical plate through which the contacts extend in the front-to-back direction.

16. The electrical connector as claimed in claim 15, further including a metallic shielding plate located between two rows of said contacts, wherein said shielding plate forms a space communicating with the vertical space in the vertical direction and filled with the waterproofing glue.

17. The electrical connector as claimed in claim 12, wherein the injection opening is filled with the waterproofing glue to form an engagement section.

18. The electrical connector as claimed in claim 12, wherein the circumferentially groove extends with 360 degrees circumferentially.

19. The electrical connector as claimed in claim 12, wherein a pair of ridged structures are located by two sides of the circumferential groove so as to strictly prevent the glue from escaping from the circumferential groove.

20. The electrical connector as claimed in claim 12, wherein the injection opening is formed in only the top wall of the shell.

* * * * *